US007766710B2

(12) United States Patent
Braud et al.

(10) Patent No.: US 7,766,710 B2
(45) Date of Patent: Aug. 3, 2010

(54) DISCONNECTABLE BUOYANT TURRENT MOORING SYSTEM

(75) Inventors: Jean Braud, La Turbie (FR); Stein Vedeld, La Turbie (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 12/090,357

(22) PCT Filed: Oct. 17, 2006

(86) PCT No.: PCT/EP2006/067521

§ 371 (c)(1),
(2), (4) Date: May 22, 2008

(87) PCT Pub. No.: WO2007/045662

PCT Pub. Date: Apr. 26, 2007

(65) Prior Publication Data

US 2008/0242166 A1 Oct. 2, 2008

(30) Foreign Application Priority Data

Oct. 17, 2005 (EP) ..... 05109655

(51) Int. Cl.
*B63B 22/02* (2006.01)

(52) U.S. Cl. ..... 441/4

(58) Field of Classification Search ..... 114/230.12; 441/4, 5; 166/352; 141/279
See application file for complete search history.

(56) References Cited

U.S. PATENT DOCUMENTS

| | | | | |
|---|---|---|---|---|
| 4,142,584 | A * | 3/1979 | Brewer et al. | 166/359 |
| 5,356,321 | A * | 10/1994 | Boatman et al. | 441/3 |
| 2007/0264889 | A1 * | 11/2007 | Boatman et al. | 441/5 |

FOREIGN PATENT DOCUMENTS

| | | | |
|---|---|---|---|
| WO | 93/24731 | A | 12/1993 |
| WO | 93/24733 | A | 12/1993 |
| WO | 99/30963 | A | 6/1999 |

* cited by examiner

*Primary Examiner*—Ed Swinehart
(74) *Attorney, Agent, or Firm*—Young & Thompson

(57) ABSTRACT

A mooring system includes a vessel with a lower-side cavity, a turret extending from deck level to the cavity, and a coupling mechanism releasably attaching a mooring buoy to the cavity, at least one buoy-supported riser. The riser end has a coupling member, the riser being slidable via a buoy opening, a riser connector member being attached to a movable transport member upwardly displaceable by a drive element, for: when the buoy and vessel are coupled, attaching the riser connector member to the transport member transporting the transport member upward while sliding the riser through the buoy and attaching the coupling member to a vessel transfer duct, and for lowering the riser while sliding the riser through the buoy until the connector member is supported by the buoy, prior to coupling member release, and release of the riser connector member from the transport member, followed by buoy lowering.

2 Claims, 5 Drawing Sheets

DISCONNECTABLE BUOYANT TURRENT MOORING SYSTEM

FIELD OF THE INVENTION

A buoy-turret moving system (BTM) is a disconnectable buoy turret system in which a buoy is connected to a central structural connector which is placed at the lower end of a turret which is placed within a moon pool of a vessel. The buoy has such a volume that as the structural connector is opened, the buoy will sink to a predetermined submerged level due to the weight of the attached anchor lines.

A BTM for a floating production storage and offloading (FPSO) requires high pressure valves and an Emergency Shut Down (ESD) system for the risers which are connected to the disconnectable buoy. The ESD system will ensure a fast release in case of an emergency.

BACKGROUND OF THE INVENTION

In some prior art BTM systems these riser connections and ESD valves systems are placed in an enclosed space within the turret near the structural connector of the BTM. To avoid the risk of an explosion in these enclosed spaces, ventilation of the enclosed spaces is needed for example via ventilation shafts and forced air. The solution of using an inert gas in the enclosed space can also avoid the risk of an explosion but the space can not be entered for maintenance and repair activities or in emergency situations. Furthermore to have an enclosed turret space under water also creates the danger of ingress of water due to leakage of (damaged) seals between buoy and turret.

To avoid the above-mentioned problems it is known in the prior art to pull up each riser separately through the buoy up through the rotatable turret to the vessel deck, so that the riser connections are in an open and natural ventilated environment as is shown in U.S. Pat. No. 5,316,509 in the name of Sofec. This publication shows a BTM system with vertical displaceable risers in a turret which is rotatably supported in a moon pool of a vessel via a bearing system.

The patent publication WO9324733 in the name of Statoil shows a submerged buoy which is provided with a weight-carrying main bearing so that it can rotate around its own axis when it is connected to the bottom of a vessel. This publication also shows a riser deck with riser connectors and valves which can be pulled up to deck level and which can be lowered onto the buoy before the buoy is disconnected from the vessel. This design can be a solution for a limited amount of risers as the axial radial bearing of the buoy can only be fabricated to a certain maximum diameter and because the vertical displacement of one large diameter deck within the rolling vessel creates large problems related to the guiding system. It is anyway from a maintenance point of view, not preferred to have a buoy concept with an expensive weight-carrying bearing which lies in the seawater.

Patent publication WO8808806 also shows a movable deck to which risers and valves are connected. The deck is pulled up only to tension the attached vertically tensioned risers from the BTM systems as these systems which differ are provided with flexible curved risers. The deck can be lowered onto a very large size buoy of which the top is above water level when it is connected to a vessel via a turret which has a reduced height. This design does not provide a quick disconnectable system as the large buoy has to be flooded with water before it is able to sink out of the turret-moon pool. There is also not one central single structural connector that can be opened to quickly disconnected the buoy from the turret.

SUMMARY OF THE INVENTION

The present invention relates to the field of internal turret single point mooring systems that are permanently integrated into the hull of the FPSO. Such a system allows the vessel to passively "weathervane" around multiple anchor legs, while simultaneously transferring fluids, power, and communications signals between the FPSO and the seabed.

The internal turret mooring system consists of a cylindrical turret structure located within a cylindrical moon pool integrated in the hull of the FPSO. A large diameter segmented roller bearing can connect the turret to the vessel. The bearing is mounted to its support structures by high strength, hydraulically pre-tensioned bolts. The main bearing which rotatably supports the turret within the moon pool of a vessel is preferable placed above water level, near the deck of the vessel. There are, depending on the number of risers, different bearing arrangements possible for supporting the turret on the vessel, for example an axial radial bearing system, a segmented bearing system, a bogie wheel system or a sliding bearing system.

Located atop the turret is installation and production equipment. The swivel stack is located above the turret, with associated piping and access arrangements.

The lower section of the turret structure houses the riser buoy that is connected by a hydraulic structural connector at the top.

The upper end of each anchor leg is connected to an articulated universal joint underneath the buoy. The lower end of each anchor leg is connected to an anchor that is embedded into the seabed.

Export oil and gas and production well fluids pass between the seabed and the riser buoy via flexible curved risers. Hydraulic and electrical control umbilicals are also routed between the riser buoy and the seabed. At the bottom of the buoy the risers and umbilicals are routed slidable through tubular guides (I-tubes) to a riser deck at the top of the buoy.

The top of the buoy forms a recess where risers and umbilicals terminate. The riser termination flanges are connected to the turret piping via hydraulically actuated connectors. From the turret the fluids are routed to the swivel stack and then to the FPSO. The riser buoy is a fabricated steel cylindrical shell structure. The size has been determined based on the buoyancy required for keeping the risers and anchor legs at the specified level in disconnected mode. The compartments have been designed to secure that the buoy is floating with the accidental flooding of 2 annular or one internal compartment. The buoy is further shaped such that it will not contact other turret parts during disconnection.

The buoy is connected to the turret with one structural connector which is placed below water level on center line of the turret. The central pipe houses the connecting wire rope when the buoy is connected, and it transfers loads to the structural connector. The volume of the buoy is such that it will sink to a predetermined depth upon disconnection from the turret, due to the weight of the anchor lines.

The invention is regarding an improved disconnectable submerged buoy-turret mooring (BTM) system for a large amount of risers which can be operated safely, which is easy to maintain and which can be disconnected and connected quickly.

A mooring system according to the invention comprises a vessel with a cavity at a lower side, a turret extending from deck level to the cavity, and a mooring buoy releasably attached to the cavity via a coupling mechanism, at least one riser being supported by the mooring buoy, wherein, the riser has at its end a coupling member, the riser being slidable via an opening in the buoy, a riser connector member being attached to a movable transport member which can be displaced from a lower level to a higher level by a drive element, for:

when the buoy is coupled to the vessel, attaching the riser connector member to the transport member transporting the transport member upward towards deck level while sliding the riser through said buoy and attaching the coupling member to a transfer duct on the vessel, and for lowering the riser towards the buoy while sliding the riser through said buoy until the connector member is being supported by the buoy, prior to release of the coupling member, and release of the riser connector member from the transport member, followed by lowering of the buoy together with the connector member.

According to the invention the riser couplings and the ESD valves which are placed on top of the riser couplings are connected to one or more vertically displaceable riser decks which are placed within the rotatably supported turret.

This configuration makes it possible to pull a riser deck which is provided with the valves and riser connections, up to the deck level were they are in an open ventilated space and where maintenance and repair activities can be easily performed.

The sub-sea lines can have any arrangement but in the attached drawings an example of 3 sectors of 4 risers, with a mooring line pattern of 3 groups. Each group of risers is connected to a riser deck section. Each sector is fitted with a riser deck, a guiding trolley and a dedicated lifting winch. Each of the three riser decks (one in each sector) houses the ESD valves and the lower halves of the fluid and electric connectors. When the mooring buoy is disconnected, the riser decks are on top of the buoy.

In a connection procedure the buoy is hauled into the moon pool and connected to the rotatable turret via the structural connector which is placed at the center line of the turret. The submerged riser deck is then coupled to the guided trolley system and the combination of riser deck and trolley is pulled up to deck level with the aid of a winch, in which position the riser deck-trolley combination is fixed. A riser deck or riser deck section which supports a group of risers, can be connected to the trolley system in many ways, for example via pins. The trolley can be provided with a guiding wheel arrangement and is movable over a track which is placed along the axis of the turret. The trolley is connected via a cable or chain to a winch on the deck of the vessel. For a system with multiple decks, each trolley can be provided with its own winch system so that simultaneously lifting or lowering of several trolleys along its track is possible. Alternatively one central winch can be used for displacement one after the other of each trolley over its track.

Fixing the movable riser deck at the deck level of the vessel and decoupling the trolley from the riser deck is also a possibility. When the riser deck has been secured, the umbilical/hydraulic lines/electric power cables are connected, and the fluid connectors are retracted and connected.

In the event of for example cyclonic conditions, the FPSO and the BTM will shutdown the facilities, disconnect the risers, umbilicals and Power Cables and disconnect from the Mooring Buoy. Then the FPSO will sail-away under its own power. In such a disconnection procedure first the ESD valves are closed, the risers are then disconnected from the turret piping system and the riser deck and trolley combination is lowered vertically via the track system onto the buoy using for example a 50T winch (sheaving is provided to reach the required capacity).

Once the riser deck is on the buoy, it can be decoupled from the trolley. This procedure can be done simultaneously or sequential if there are more than one riser deck sections. Hereafter the buoy can be decoupled from the rotatable turret by opening the central structural connector and sink to its predetermined submerged position.

For the reconnection, after hook-up of the FPSO to the mooring buoy the reverse procedure can be followed: the 3 riser decks are coupled again to the trolley arrangements and they will be lifted up to the FPSO main deck level and secured. The risers, umbilicals and power cables will be connected individually to the top turret part using automatic dedicated connectors. Then production can be started again.

The disconnection and installation time is therefore greatly reduced for a known rotatable turret-BTM design as a group of risers can be pulled up and lowered all at once.

For a large amount of risers multiple movable riser decks sections are needed following from the chosen anchor line arrangements as often a bundle of risers is placed within the free space of a grouped anchor line arrangement.

BRIEF DESCRIPTION OF THE DRAWINGS

An embodiment of a buoy-turret mooring system according to the invention will be described by way of example with reference to the accompanying drawings. In the drawings.

DETAILED DESCRIPTION OF EMBODIMENTS

Figure 1:
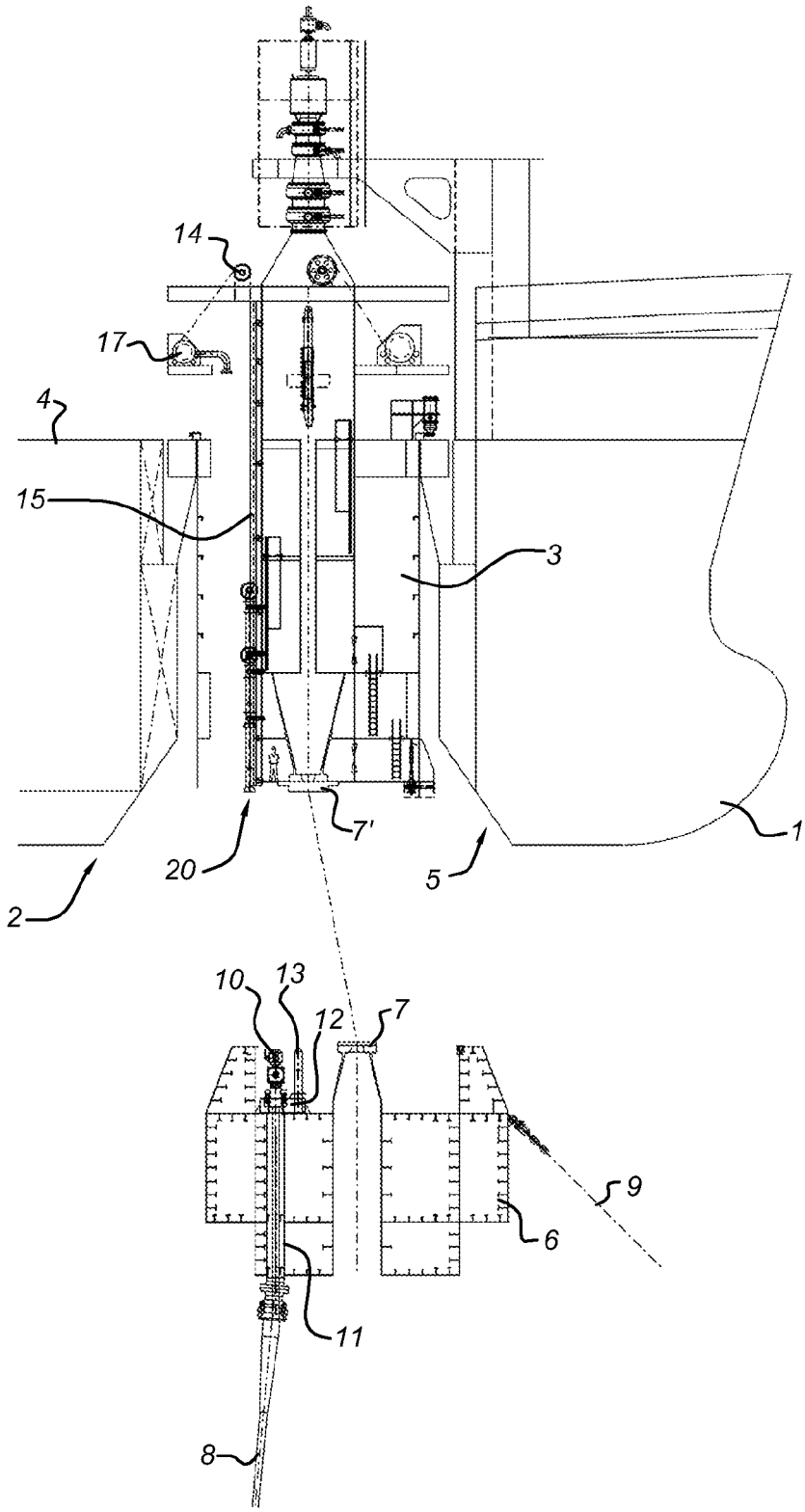
FIG. 1 shows a vessel and a buoy in a disconnected state, the connector member or riser deck being supported on the buoy.

FIG. 1 shows a mooring system according to the present invention with a vessel 1 having a moon pool 5, in which a turret 3 is rotatably suspended via axial-radial bearings. The turret 3 can be connected via a central connector 7' to a complementary connector 7 of a releasable buoy 6 which is anchored to the sea bed via anchor chains 9. The buoy 6 carries a number of risers 8 which are slidably supported through the buoy via I-tubes 11 and are connected to the top of the buoy via connector members or riser decks 12. At the top of the riser 8, the coupling member 10 comprises a mechanical connector for attaching to piping 17 on deck of the vessel 1 and an ESD valve system for closing of the risers 8. After coupling the structural connectors 7, 7', the riser deck 12 can be attached via a guide pin 13 to trolley 20 which is movable along a vertical track 15 in the turret 3. The trolley 20 can be pulled towards deck level via a winch 14 above deck level.

Figure 2:
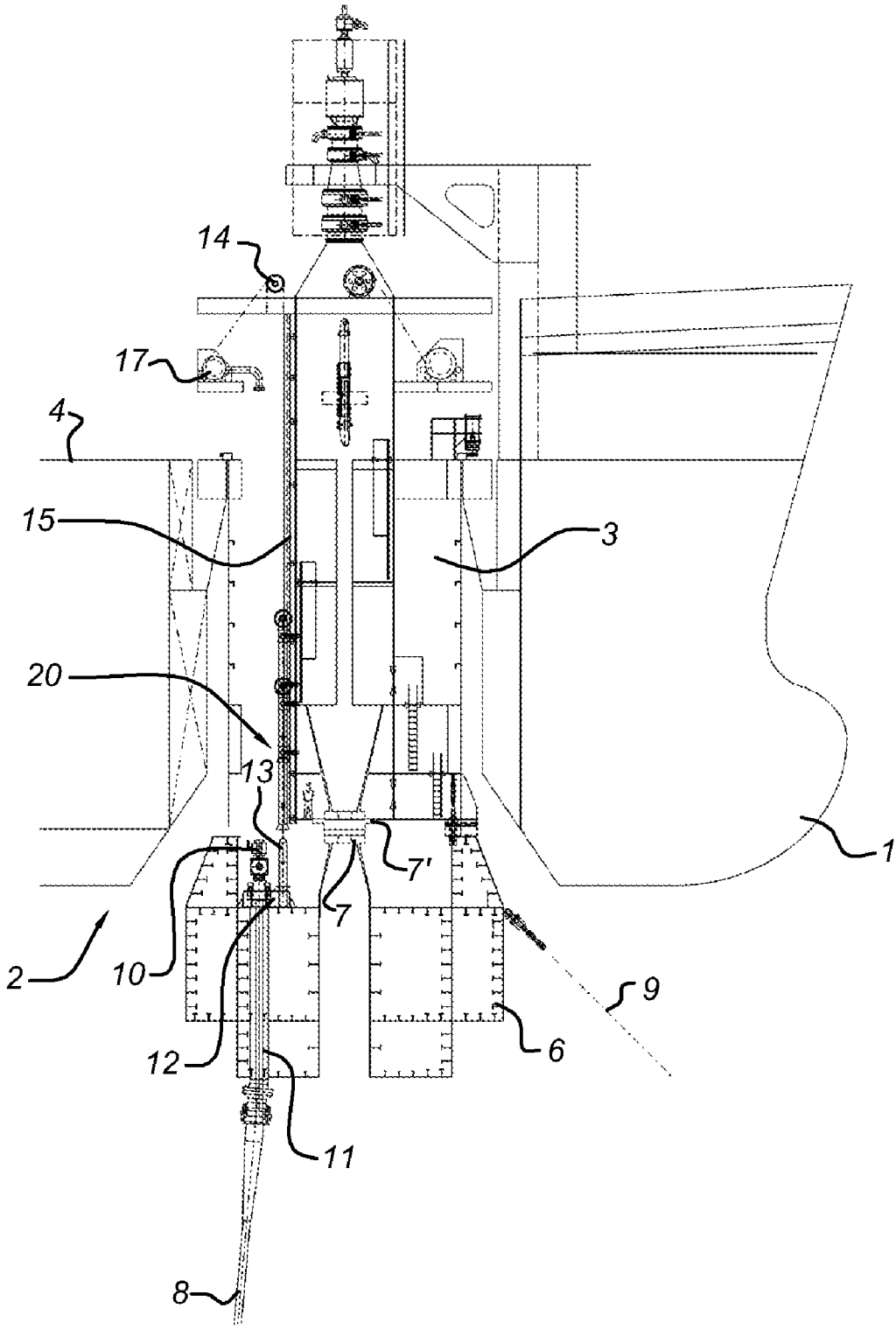
FIG. 2 shows the coupling mechanism of the buoy being engaged with the vessel, the connector member being disengaged from the transport member.
Figure 3:
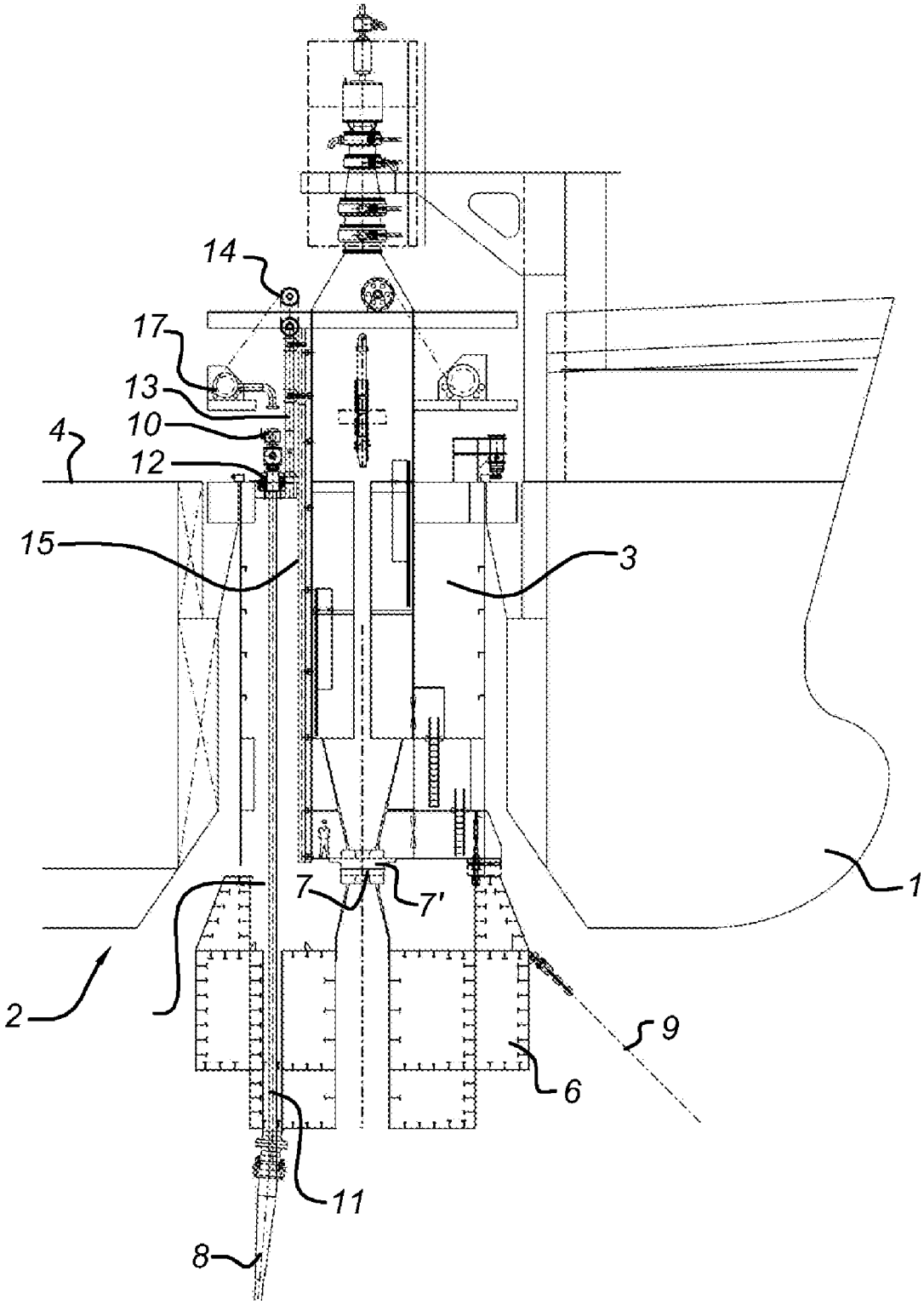
FIG. 3 shows the connector member being coupled to the transport member and pulled by the drive element to deck level.

FIG. 2 shows the buoy 6 in a connected state in which the central structural connectors 7, 7' are attached and the guide pin 13 on the riser deck 12 is aligned for coupling with the trolley 20. In FIG. 3 it can be seen that the riser 8 has been pulled upward by the trolley 20 up to deck level for connection to piping 17.

Figure 4A:
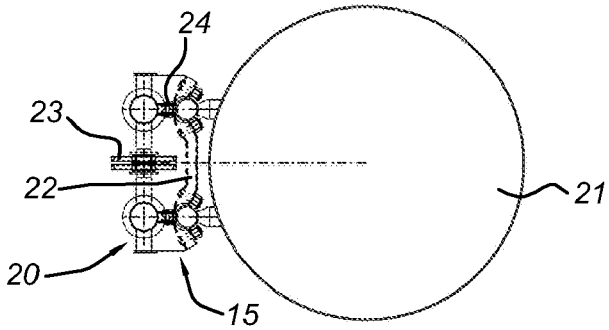
FIGS. 4*a*-4*c* show details of the trolley system of the present invention.
Figure 4B:
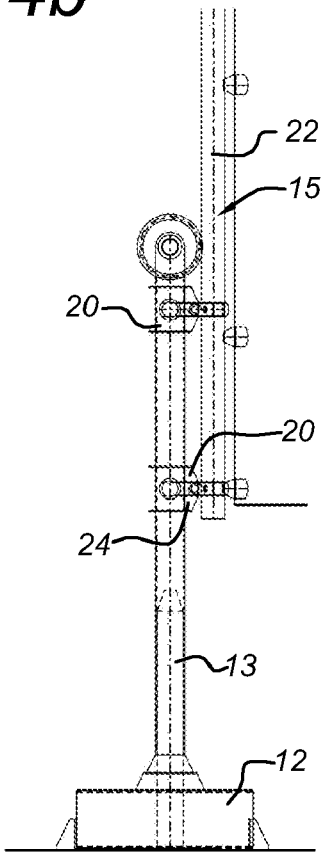
Figure 4C:
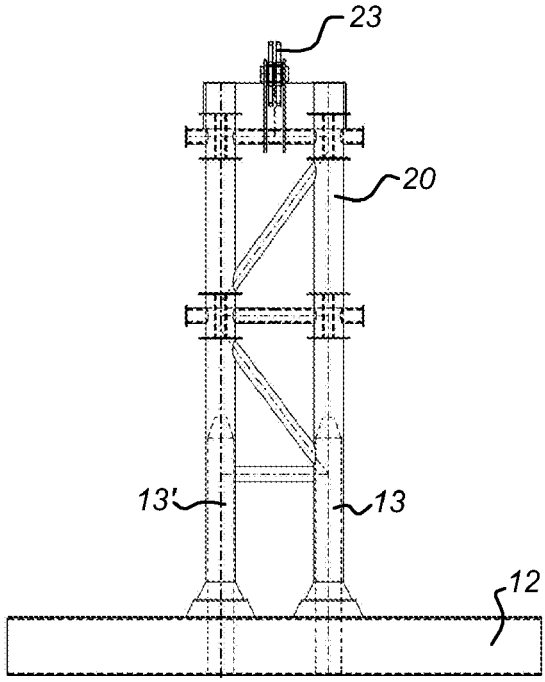

FIG. 4*a* shows a top view of the track 15 comprising a guiding rail 22 that is attached to a central column 21 in the turret 3. Via a sheave 23 the trolley 20 is pulled upward along the guiding rail 22 against which it is supported via wheels 24. FIGS. 4*b* and 4*c* show that the riser deck 12 comprises two pins 13, 13' which attach to the trolley 20.

Figure 5:
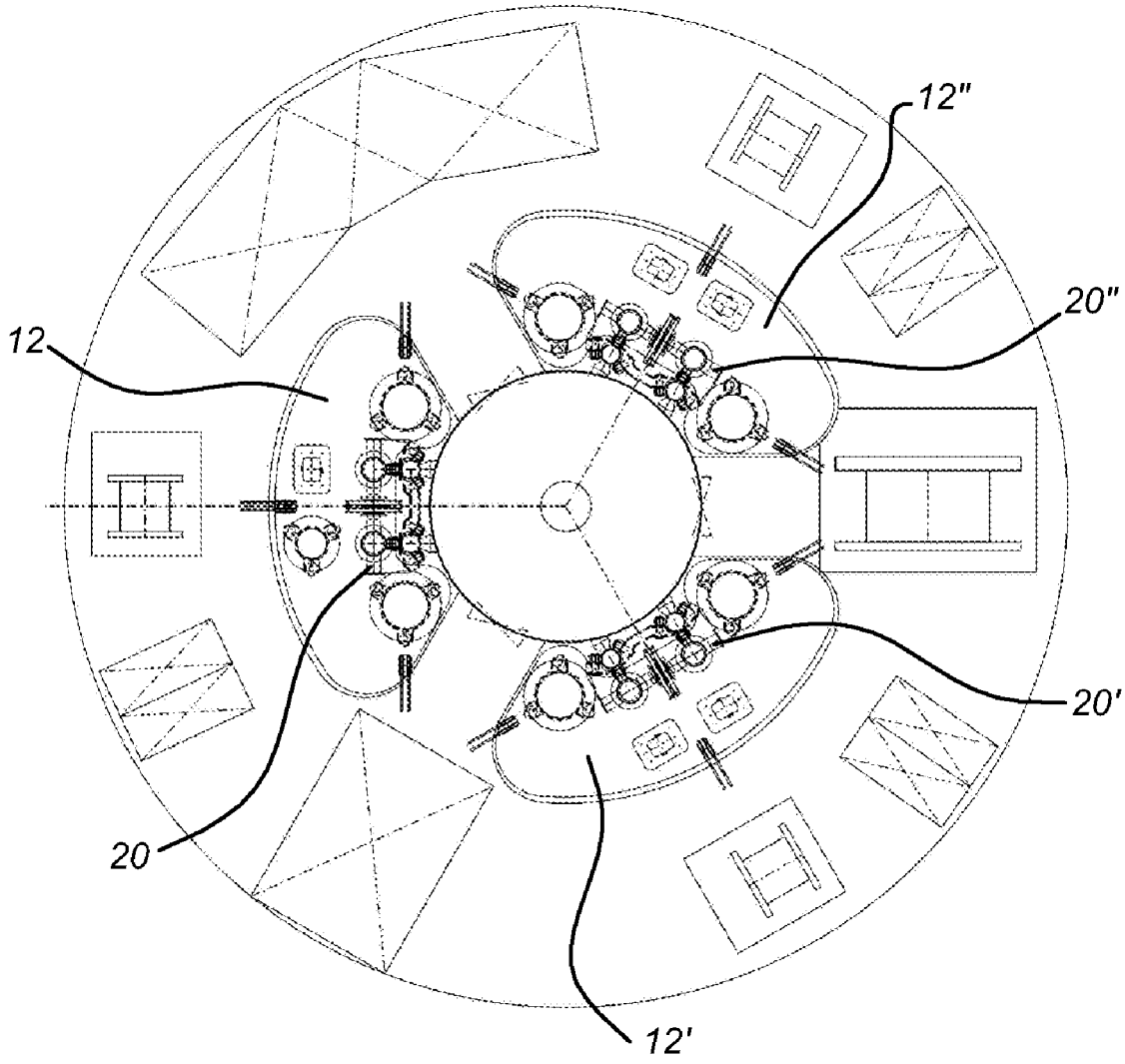
FIG. 5 shows a top view of three connector members 12, 12', 12" (riser supporting decks).

FIG. 5 shows an arrangement with three riser connection decks 12, 12', 12" each supported by a respective trolley 20, 20', 20".

The invention claimed is:

1. A mooring system comprising:

a vessel with a cavity at a lower side, a turret extending from deck level to the cavity, a mooring buoy releasably attached to the cavity via a coupling mechanism, and at least one riser being supported by the mooring buoy and slidably received in a channel in the mooring buoy, wherein the riser has at an end thereof a coupling member for coupling to piping on the vessel and a riser connector member supported on the mooring buoy when the mooring buoy is disconnected from the vessel, a substantially vertically oriented track extending from a lower level towards said deck level, a movable trolley which is releasably engagable with the connector member and which is displaced along said track from said lower level to a higher level by a drive element, for:

when the mooring buoy is coupled to the vessel, attaching the riser connector member to the trolley and transporting the trolley upward towards said deck level while sliding the riser through said channel followed by attaching the coupling member to a transfer duct on the vessel, and for lowering the riser towards the mooring buoy while sliding the riser through said channel until the connector member is supported by the mooring buoy, prior to release of the riser connector member from the trolley, followed by lowering of the mooring buoy together with the connector member and the riser attached thereto.

2. The mooring system according to claim 1, wherein the coupling member comprises a valve for closing the riser and a connector for attaching the riser in a fluid tight manner to the transfer duct on the vessel.

* * * * *